US007162195B2

(12) United States Patent
Matsuyama et al.

(10) Patent No.: US 7,162,195 B2
(45) Date of Patent: Jan. 9, 2007

(54) IMAGE FORMING APPARATUS

(75) Inventors: Kazuhiro Matsuyama, Ikoma (JP); Atsushi Ide, Nara (JP); Yoshinobu Tateishi, Shiki-gun (JP); Yasunori Minakuchi, Shiki-gun (JP); Toshiya Mikita, Yao (JP); Shinichi Takeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/630,470

(22) Filed: Jul. 29, 2003

(65) Prior Publication Data

US 2004/0022566 A1 Feb. 5, 2004

(30) Foreign Application Priority Data

Jul. 31, 2002 (JP) ..... P2002-223650

(51) Int. Cl.
*G00G 15/00* (2006.01)

(52) U.S. Cl. ..... 399/404; 399/405

(58) Field of Classification Search ..... 399/403–405; 271/184, 265.01; 270/58.02, 58.03, 58.1
See application file for complete search history.

(56) References Cited

U.S. PATENT DOCUMENTS 4,977,432 A * 12/1990 Coombs et al. ..... 399/404
5,542,655 A * 8/1996 Murakami ..... 270/58.09
5,848,346 A * 12/1998 Takashiro ..... 399/404
5,918,872 A * 7/1999 Kato et al. ..... 270/58.12
6,109,605 A * 8/2000 Hirota et al. ..... 271/186
6,113,094 A * 9/2000 Horiguchi et al. ..... 271/176
6,263,185 B1 * 7/2001 Kato et al. ..... 399/381
6,290,220 B1 * 9/2001 Takehara et al. ..... 270/58.12
6,353,727 B1 * 3/2002 Muraoka et al. ..... 399/410
6,445,891 B1 * 9/2002 Shiraishi ..... 399/82
6,473,590 B1 * 10/2002 Matsumoto et al. ..... 399/404
6,494,453 B1 * 12/2002 Yamada et al. ..... 271/288
6,748,858 B1 * 6/2004 Yamaguchi ..... 101/232
2002/0021924 A1 * 2/2002 Mimura et al. ..... 399/407
2002/0044810 A1 * 4/2002 Sato et al. ..... 399/405

FOREIGN PATENT DOCUMENTS

JP 10-310320 11/1998

* cited by examiner

*Primary Examiner*—Anthony H. Nguyen
(74) *Attorney, Agent, or Firm*—David G. Conlin; Steven M. Jensen; Edwards Angell Palmer & Dodge LLP

(57) ABSTRACT

An image forming apparatus, determining in sorting recording sheets whether or not recording sheet transport interval is shorter than a first predetermined value, sets the longest time settable as a delay time when the interval is longer than the first value. When the interval is shorter than the first value, the apparatus, determining whether or not the interval is shorter than a second predetermined value, sets the shortest delay time settable when the interval is shorter than the second value, and sets a reference delay time when the interval is longer than the second value. The apparatus prevents sheet jam before a sheet eject mechanism by ensuring that the mechanism returns to an initial position before the front end of a following sheet reaches sheet eject rollers after the rear end of a preceding sheet passes through the rollers.

10 Claims, 12 Drawing Sheets

FIG. 12

| SIZE | NORMAL CONTROL | | DELAY CONTROL | |
|---|---|---|---|---|
| | SPEED (ppm) | INTERVAL(ms) | SPEED (ppm) | INTERVAL(ms) |
| A5 | 26 | 1,038 | 26 | 1,038 |
| B5 | 26 | 752 | 26 | 752 |
| B5R | 18 | 1,137 | 18 | 1,137 |
| A4 | 26 | 513 | 24 | 705 |
| A4R | 18 | 795 | 18 | 795 |
| B4 | 15 | 889 | 15 | 889 |
| A3 | 13 | 1,026 | 13 | 1,026 |
| INV | 26 | 1,114 | 26 | 1,114 |
| LT | 26 | 462 | 24 | 655 |
| LTR | 18 | 944 | 18 | 944 |
| Legal | 15 | 961 | 15 | 961 |
| Ledger | 13 | 923 | 13 | 923 |

IMAGE FORMING APPARATUS

BACKGROUND OF THE INVENTION

1. Technical Field of the Invention

The present invention relates to image forming apparatus such as copying machines, printers, and facsimile machines, for, when sheets with images formed thereon are ejected to a sheet eject section, sorting the sheets to be ejected by displacing the sheets in a direction orthogonal to a sheet transport direction.

2. Description of Related Art

Because of increasing unitization of image forming apparatus, peripheral devices for performing specific functions that a user desires are selectively combined to be installed in a body of the image forming apparatus. However some of the functions do not require installation of additional peripheral device(s), and some users do not desire such a function as to involve the installation of additional peripheral device (s). If a user does not desire such a post-processing function as of sorting or stacking sheets to which image forming processing is performed, it is not necessary to install a post-processing device for performing the sorting or stacking processing as a peripheral device in the image forming apparatus. In this case, all the sheets with images formed thereon are ejected to and stacked on a single sheet eject tray.

If an image forming apparatus is not provided with the post-processing device as a peripheral device and thus all the sheets with images formed thereon are ejected to and stacked on a single sheet eject tray, when image forming processing with regard to a plurality of image forming jobs directed by a plurality of users is performed in succession, sheets with images formed thereon in the corresponding processing to the respective jobs are stacked one on another on the single sheet eject tray. Thus it is difficult for the users to distinguish among the sheets, and the users have trouble in taking out of the sheet eject tray the sheets corresponding to the jobs they instructed. In particular if the sheets are ejected face down, namely, with image-formed sides thereof down, the users must turn over the sheets on the sheet eject tray, sheet by sheet, to find their corresponding sheets. This problem also occurs in a single user when image forming processing is performed to plural copies of sheets with each copy containing a plurality of sheets.

To solve the above problem, one example of conventional image forming apparatus is provided with a mechanism for displacing sheets selectively to a plurality of positions in a direction orthogonal to a sheet transport direction and ejecting the sheets onto a sheet eject tray. In an image forming apparatus without a post-processing device as a peripheral device, the arrangement allows sheets with images formed thereon in respective image forming processing performed in succession to be sorted on a single sheet eject tray without difficulty. Consequently, each user can easily take out of the sheet eject tray the sheets corresponding to the image forming processing the user directs.

For displacing a sheet eject position selectively in a direction orthogonal to a sheet transport direction as described above, there is a method in which the sheet eject tray is displaced in the direction orthogonal to the sheet transport direction. There is also another method in which a sheet transport mechanism for guiding a sheet to the sheet eject tray is displaced in the direction orthogonal to the sheet transport direction. Since a complicated device is required for displacing a sheet halfway on a sheet transport path provided within an image forming apparatus, in most of the image forming apparatus according to the latter method a sheet eject mechanism supporting sheet eject rollers rotatably at a sheet eject slot is arranged to be displaced in the direction orthogonal to the sheet transport direction.

In this case, the sheet eject mechanism is arranged in the vicinity of the sheet eject slot to be movable between an initial position and a sorting position in the direction orthogonal to the sheet transport direction. In displacing a sheet to be ejected to the sheet eject tray from the initial position to the sorting position in the direction orthogonal to the sheet transport direction, the sheet eject mechanism moves from the initial position to the sorting position after the front end of the sheet passes through sheet eject rollers; and then the mechanism returns from the sorting position to the initial position after the rear end of the sheet passes through the sheet eject rollers.

Arranged opposite a sheet-stacking side of the sheet eject tray, the sheet eject mechanism is in most cases provided with a contact-type sensor for detecting height of sheets stacked on the sheet eject tray. The sensor has an actuator swingably mounted thereon which extends downward and abuts on the uppermost sheet of the sheet stack on the sheet eject tray. According to a swing angle of the actuator, the sensor detects the height of sheets stacked on the sheet eject tray.

Since a sheet whose rear end passes through the sheet eject rollers is affected by air resistance while it is falling toward the sheet eject tray, the sheet takes a certain time to fall from the sheet eject mechanism to a level where the sheet does not get contact with the actuator of the contact-type sensor. In general, the sheet-stacking side of the sheet eject tray slopes down to a body of the image forming apparatus so that the single contact-type sensor arranged at a part of the body above the sheet eject tray detects the height of the sheet stack with various sizes of sheets.

Therefore a sheet ejected by the sheet eject rollers, after falling onto the uppermost sheet of the sheet stack on the sheet eject tray, moves in a direction opposite to a sheet eject direction along the slope of the sheet-stacking side, to come to a stop with rear end thereof abutting on an end of the sheet eject tray on the side of the body of the image forming apparatus.

As the height of the sheet stack on the sheet eject tray reaches a full level, the actuator of the contact-type sensor is in constant contact with the uppermost sheet of the sheet stack on the sheet eject tray. When the sheet eject mechanism starts to return from the sorting position to the initial position while an ejected sheet is moving in the direction opposite to the sheet eject direction, the unstable sheet on the move is displaced in the direction orthogonal to the sheet eject direction by external force from the actuator, causing the sheet to be placed in a disorderly way on the sheet eject tray. Accordingly, it is necessary to set the sheet eject mechanism returning to the initial position in a sufficiently delay time after the rear end of the sheet passes through the sheet eject rollers.

After the passage, it is necessary for the sheet eject mechanism to return to the initial position before the front end of a following sheet reaches the sheet eject rollers. It being considered that a transport interval between sheets tends to be shorter with speeding up of image-forming speed, it is necessary to set the sheet eject mechanism returning at the quickest timing possible after the passage through the sheet eject rollers of the rear end of a preceding sheet such that the front end of the following sheet is appropriately held between the sheet eject rollers.

The foregoing necessity causes the following problem. The sheet eject mechanism is set returning before a sheet whose rear end passes through the sheet eject rollers falls with a sufficient distance from the sheet eject mechanism. Or the sheet gets contact with the actuator of the contact-type sensor while moving in the direction opposite to the sheet eject direction after ejected by the sheet eject rollers. Thus, ejected sheets cannot be stacked neatly at a predetermined position on the sheet eject tray, with the result that the sheets cannot be sorted properly.

SUMMARY OF THE INVENTION

An object of the present invention is to provide an image forming apparatus capable of sorting sheets properly on a sheet eject tray, designed by adjusting, according to a transport interval between sheets in sorting processing, delay time required for a sheet eject mechanism to return to an initial position after ejecting a sheet, or image-forming speed, such that a preceding sheet is sufficiently distant from a sheet eject mechanism during a time difference between the time required for the front end of a following sheet to reach sheet eject rollers after the rear end of the preceding sheet passes through the sheet eject rollers and the time required for the sheet eject mechanism to return from a sorting position to an initial position (hereinafter referred to as the return time), thereby ensuring that the sheets ejected from the sheet eject mechanism are prevented from contacting part of the sheet eject mechanism.

To obtain the above object, the image forming apparatus of the present invention comprises:

- a sheet eject mechanism movable between an initial position and a sorting position in a direction orthogonal to a sheet transport direction in processing of sorting sheets by copy or by image-forming job, with which sheets with images formed thereon in an image forming section are ejected selectively to a plurality of positions in the direction orthogonal to the sheet transport direction on a sheet eject tray; and
- a control device for regulating a delay time required for the sheet eject mechanism moving from the initial position to the sorting position with a sheet held therein to start to return to the initial position after ejecting the sheet such that the sheet eject mechanism completes its return to the initial position within a transport interval at which a sheet is transported to the sheet eject mechanism.

When sorting processing is performed with the sheet eject mechanism, it is necessary to set the sheet eject mechanism returning to the initial position after a sheet ejected from the sheet eject mechanism positioned at the sorting position is sufficiently distant from the sheet eject mechanism, or, after the sheet completes its movement in a direction opposite to a sheet transport direction. Otherwise the sheet gets contact with the sheet eject mechanism, so that sheets are placed in a disorderly way at unfixed positions in the direction orthogonal to the sheet transport direction on the sheet eject tray and thus cannot be sorted properly.

When the height of a sheet stack on the sheet eject tray is below a predetermined level, a sheet ejected from the sheet eject mechanism falls to be sufficiently distant from the sheet eject mechanism. In the case, it is necessary to arrange the sheet eject mechanism not to get contact with the falling sheet. When the height of the sheet stack on the sheet eject tray is above a predetermined level, part of the sheet eject mechanism (an actuator as a detector) is in constant contact with the uppermost sheet of the sheet stack. In the case, it is thus necessary to arrange external force in the direction orthogonal to the sheet eject direction not to act on the fallen sheet which is on the move in the direction opposite to the sheet eject direction and accordingly unstable.

The delay time required for the sheet eject mechanism to start its return to the initial position after ejecting a sheet is limited by the transport interval at which the sheet is transported to the sheet eject mechanism. This is because the sheet eject mechanism, after ejecting a preceding sheet at the sorting position, must return to the initial position before the following sheet reaches the sheet eject mechanism. The transport interval varies according to sheet size, namely, sheet length in the sheet transport direction, and image-forming speed, namely, the number of sheets where images are formed per unit time.

In the present invention, when sheets with images formed thereon are sorted by displacing the sheets to different positions in the direction orthogonal to the sheet transport direction and stack the sheets on the sheet eject tray, the delay time is regulated so that the sheet eject mechanism completes its return to the initial position within the transport interval. When the transport interval becomes shorter according to sheet size or image-forming speed, the delay time required for the sheet eject mechanism to start its return to the initial position after ejecting a preceding sheet is accordingly shortened, thereby ensuring that the sheet eject mechanism returns to the initial position before the following sheet reaches the sheet eject mechanism. Consequently the sheet eject mechanism is allowed to perform serial ejecting processing without trouble.

BRIEF DESCRIPTION OF THE DRAWINGS

FIG. 12 is a table illustrating the relationships between (1) sheet sizes of recording sheets where image forming is processed in the image forming apparatus and (2) image-forming speeds and transport intervals under normal control and delay control.

DESCRIPTION OF THE PREFERRED EMBODIMENTS

Figure 1:
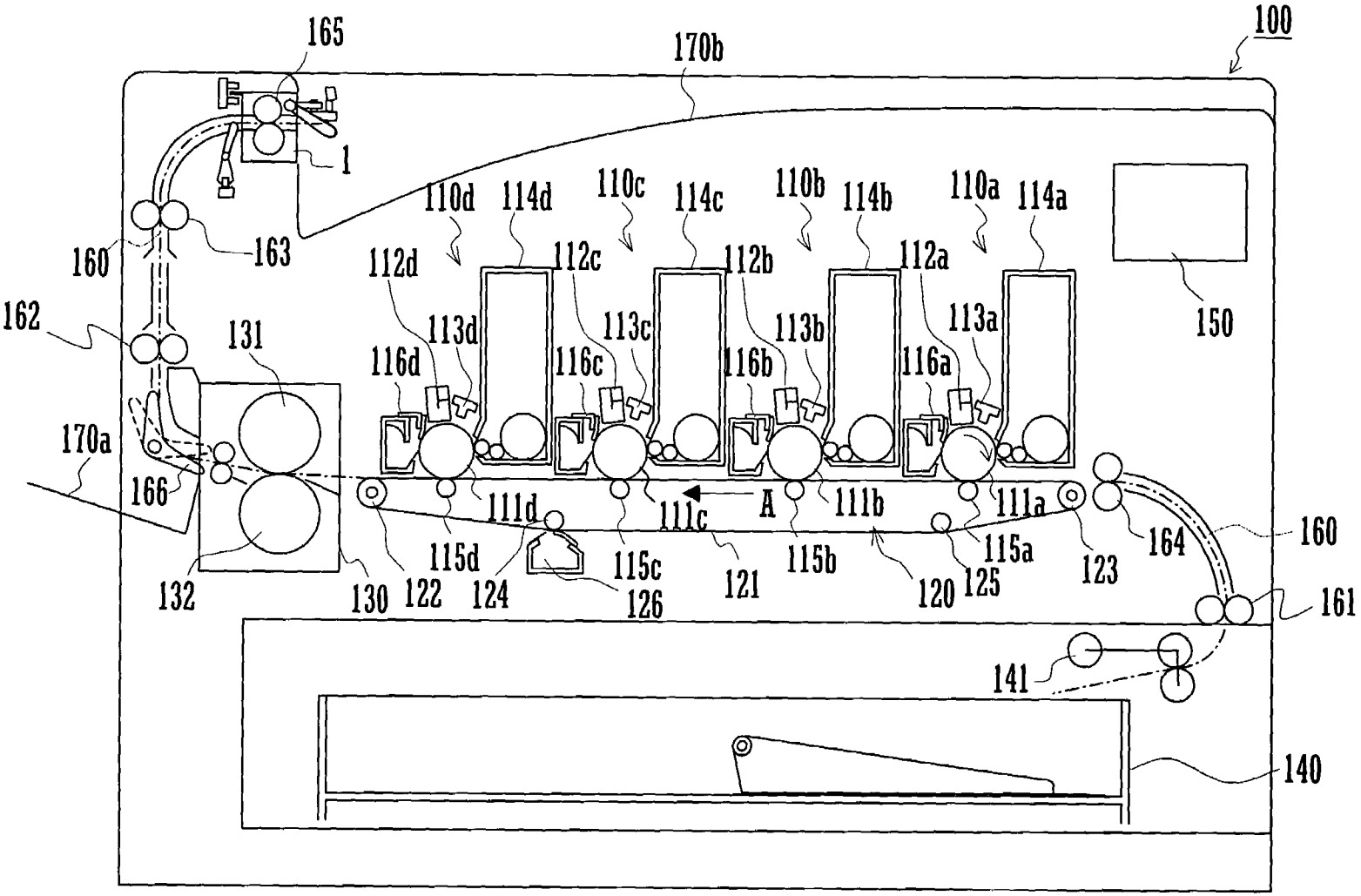
FIG. 1 is a schematic front cross-sectional view of a configuration of an image forming apparatus according to an embodiment of the present invention.

FIG. 1 is a schematic front cross-sectional view of a configuration of an image forming apparatus according to an embodiment of the present invention. An image forming apparatus 100 forms a multi-color or monochromatic image on a predetermined recording sheet (which corresponds to a sheet in the present invention) in accordance with image data supplied externally. Provided inside the image forming apparatus 100 are image forming stations 110*a* to 110*d*, a transfer/transport belt unit 120, a fixing unit 130, a sheet feed tray 140 and a control device 150. The image forming stations 110*a* to 110*d* compose an image forming section of the present invention.

The transfer/transport belt unit 120 is arranged approximately in the center inside the image forming apparatus 100. The transfer/transport belt unit 120 has an endless transfer/transport belt 121 stretched around a driving roller 122, a driven roller 123, and tension rollers 124 and 125, the belt 121 forming a loop whose upper portion is made approximately horizontal. Because of the rotation of the driving roller 122 the transfer/transport belt 121 moves in the direction of an arrow A with respect to the upper portion of the loop, and thus transports a recording sheet which electrostatically adheres to a lateral surface thereof. The transfer/transport belt 121 is cleaned by a cleaner 126 in the lower portion of the loop such that toner residue as a result from contact with photosensitive drums 111*a* to 111*d*, which will be described later, is removed and a reverse side of the recording sheet is prevented from being soiled.

The image forming stations 110*a* to 110*d* are arranged side by side along the upper portion of the loop formed by the transfer/transport belt 121. The image forming stations 110*a* to 110*d*, each with an identical configuration, respectively perform electrophotographic image forming processes in accordance with image data of the colors black, cyan, magenta, and yellow (hereinafter referred to simply as K, C, M, and Y, respectively).

For example, the image forming station 110*a* includes the photosensitive drum 111*a*, and, provided around the photosensitive drum 111*a* along the rotation direction thereof in the following order, a charging device 112*a*, an exposure unit 113*a*, a developing unit 114*a*, a transfer device 115*a*, and a cleaner unit 116*a*.

The photosensitive drum 111*a*, with a photocondutor layer formed on its surface, is supported so as to be rotatable in the direction of an arrow in FIG. 1. The charging device 112*a*, which may be either of contact type in roller or brush form, or of charger type for corona discharge processes, applies an electrostatic charge uniformly over the surface of the photosensitive drum 111*a*. The exposure unit 113*a* is: a writing head with an array of light emitting elements such as EL or LED arranged in the direction of a rotational axis (main scanning direction) of the photosensitive drum 111*a*; or a laser scanning unit(LSU) for deflecting a laser beam radiated from a laser diode in the main scanning direction by use of a rotating polygon mirror. The exposure unit 113*a* exposes the surface of the photosensitive drum 111*a* with an image light which is modulated in accordance with image data of K. As a result of the exposure by the image light from the exposure unit 113*a*, an electrostatic latent image is formed on the surface of the photosensitive drum 111*a*.

The developing unit 114*a* supplies a K toner to the surface of the photosensitive drum 111*a* where the electrostatic latent image is formed, thereby developing the electrostatic latent image into a K toner image. The transfer device 115*a* is arranged so as to face the photosensitive drum 111*a* with the upper portion of the loop formed by the transfer/transport belt 121 therebetween. To the transfer device 115*a* high voltage with an opposing charge to that of the toner is applied. The transfer device 115*a* is composed of a metal roller (e.g. stainless steel) with a diameter of 8 to 10 mm the surface of which is coated with a conductive elastic material such as EPDM or foam urethane. The transfer device 115*a* applies high voltage uniformly over a recording material which electrostatically adheres to the transfer/transport belt 121, to transfer a toner image carried on the surface of the photosensitive drum 111*a* onto the surface of the recording material. The transfer device 115*a* may be made into brush form alternatively. The cleaner unit 116*a* removes toner residue or paper particles remaining on the surface of the photosensitive drum 111*a* beyond a point where the photosensitive drum 111*a* faces the transfer device 115*a*.

Since image forming processes in accordance with image data of C, M, and Y are carried out in the image forming stations 110*b* to 110*d* respectively, as described above, the exposure units 113*b* to 113*d* are supplied with the image data of C, M, and Y respectively, and the developing units 114*b* to 114*d* have C, M, and Y toners respectively stored therein.

The sheet feed tray 140, which has recording sheets to be used for image forming stored therein, is detachably provided at a lower part in the image forming apparatus 100. Inside the image forming apparatus 100 there is a sheet transport path 160 formed by a pick-up roller 141, transport rollers 161 to 163, registration rollers 164, a flapper 166, and sheet eject rollers 165, leading from the sheet feed tray 140 through (i) the upper portion of the loop formed by the transfer/transport belt 121 and (ii) a spacing between a heat roller 131 and a pressure roller 132 to (i) a sheet eject tray 170*a* provided on a side surface of the image forming apparatus 100 and (ii) a sheet eject tray 170*b* formed on top of the image forming apparatus 100.

The sheet eject tray 170*a* stores thereon recording sheets on which images are formed, faceup, i.e., with a surface on which images are formed up. The sheet eject tray 170*b* stores thereon recording sheets on which images are formed, facedown, i.e., with a surface on which images are formed down. The flapper 166 functions to selectively switch a recording sheet eject position to either of the sheet eject tray 170*a* and the sheet eject tray 170*b*.

The transport rollers 161 to 163 are small rollers for facilitating and aiding transport of sheets, and a plurality of the transport rollers 161 to 163 are provided along the sheet transport path 160. The pick-up roller 141 are arranged at one end of the sheet feed tray 140 so as to face the top sheet of recording sheets stored in the sheet feed tray 140, for guiding recording sheets, sheet by sheet, from the sheet feed tray 140 to the sheet transport path 160. The registration rollers 164 temporarily halt a recording sheet fed from the sheet feed tray 140 before guiding the sheet to the transfer/transport belt 121 in synchronization with rotation of the photosensitive drums 111*a* to 111*d*.

More specifically, the registration rollers 164 has stopped rotating when the recording sheet is fed from the sheet feed tray 140, and starts rotating the instant the forefront of the recording sheet comes in contact with the forefront of a toner image carried on each of the photosensitive drums 111*a* to 111*d* at a point at which the photosensitive drums 111*a* to 111*d* face the transfer devices 115*a* to 115*d*. In a full-color image being formed, K, C, M, and Y toner images respectively carried on the photosensitive drums 111*a* to 111*d* are superimposed, with their positions adjusted, on one another on a recording sheet.

The fixing unit 130 includes the heat roller 131 and the pressure roller 132. The heat roller 131 is controlled based on a signal from a temperature sensor (not shown) so as to be at a predetermined fixing temperature at which toner can be fused. The pressure roller 132 is pressed against the heat roller 131 by a predetermined pressing force. The recording sheet with toner images transferred thereon is heated and pressed during passage through the fixing unit 130, so that the toner images are fused and thus firmly fixed to a surface of the recording sheet. In a full-color image being formed, K, C, M, and Y toner images transferred on a recording sheet form a full-color image produced as a result of subtractive color mixing.

In a full-color image being formed, image forming processes are performed in all of the four image forming stations 110*a* to 110*d*. In a monochromatic image being formed, image forming processes are performed in the corresponding image forming stations to a color of the image to be formed.

After passing through the fixing unit 130, the recording sheet is transported by the flapper 166 towards the transport rollers 162 and 163, to be ejected facedown onto the sheet eject tray 170*b* by the sheet eject rollers 165. The sheet eject rollers 165 are rotatably supported at an upper part on one end of the sheet eject tray 170*b* by a separator 1 constituting a sheet eject mechanism of the present invention. The separator 1 is allowed to move back and forth within a predetermined range in the direction orthogonal to FIG. 1, namely, in the direction orthogonal to the sheet transport direction (the forward-backward direction of the image forming apparatus 100). For example, when recording sheets are sorted in a series of image forming processes regarding a plurality of sets of recording sheets, the recording sheets are sorted by set and ejected to a plurality of positions in the sheet transport direction on the sheet eject tray 170*b*.

Figure 2:
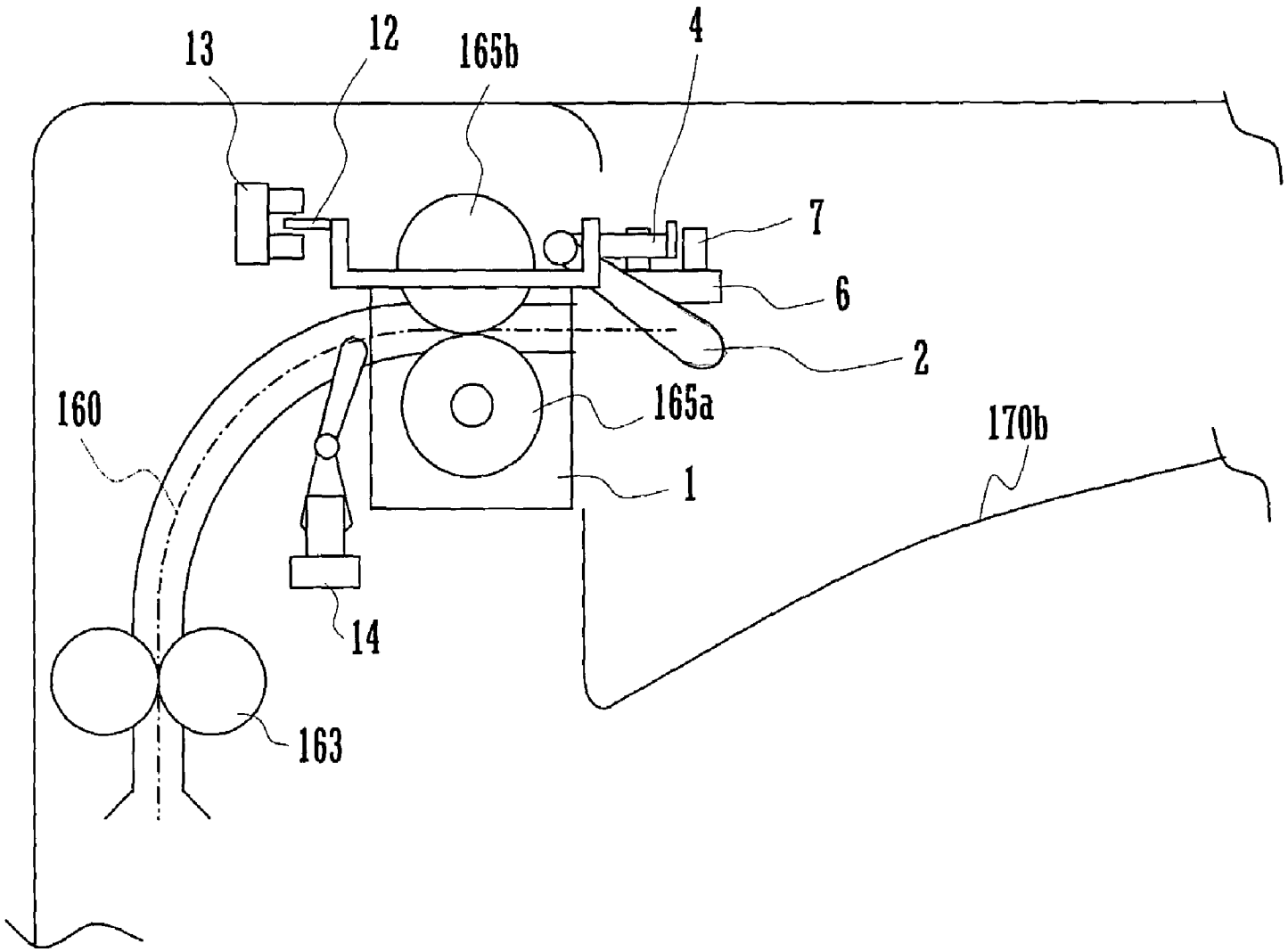
FIG. 2 is an enlarged view of a configuration of the vicinity of sheet eject rollers in the image forming apparatus.
Figure 3:
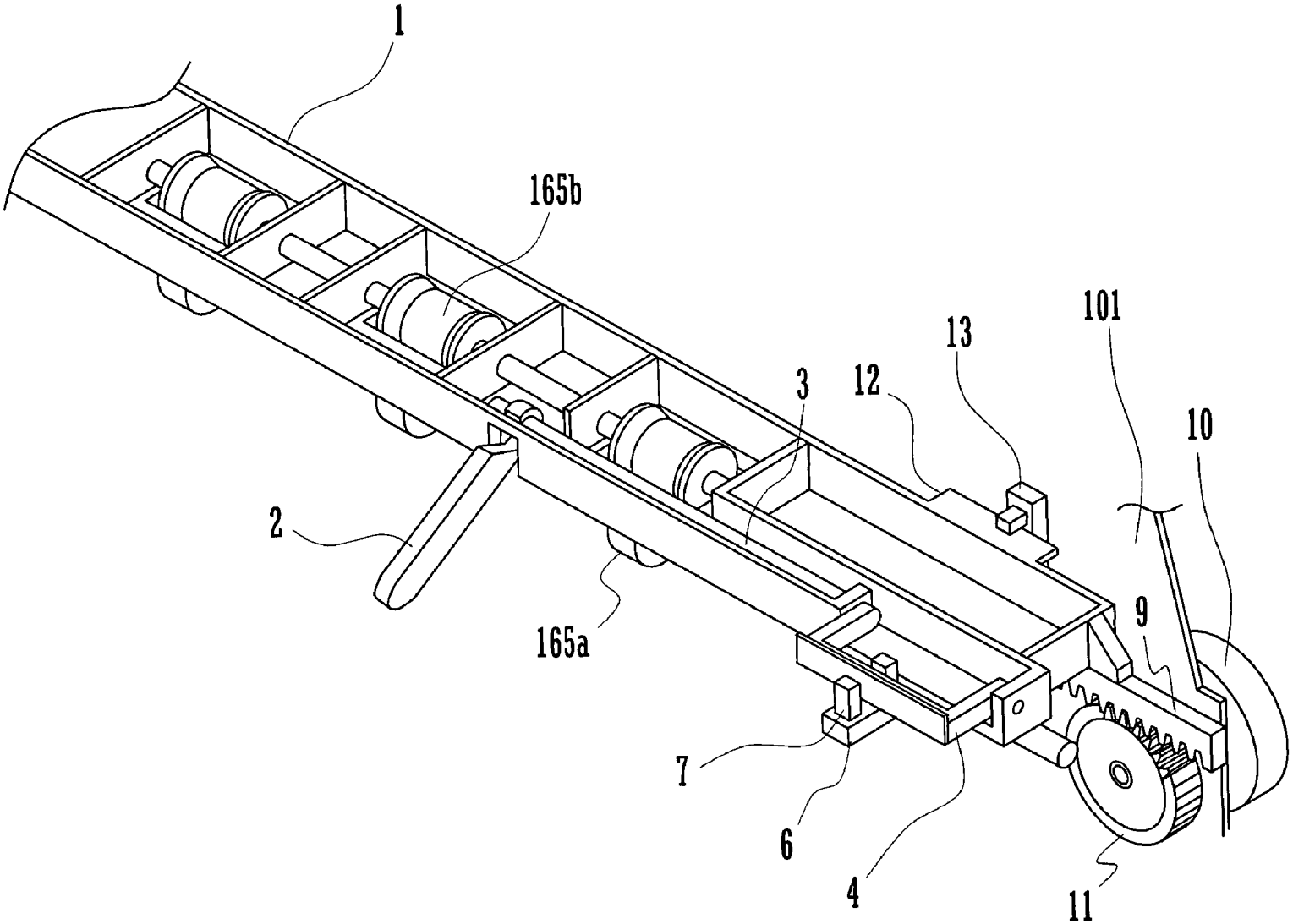
FIG. 3 is an external view of a separator in the image forming apparatus.
Figure 4:
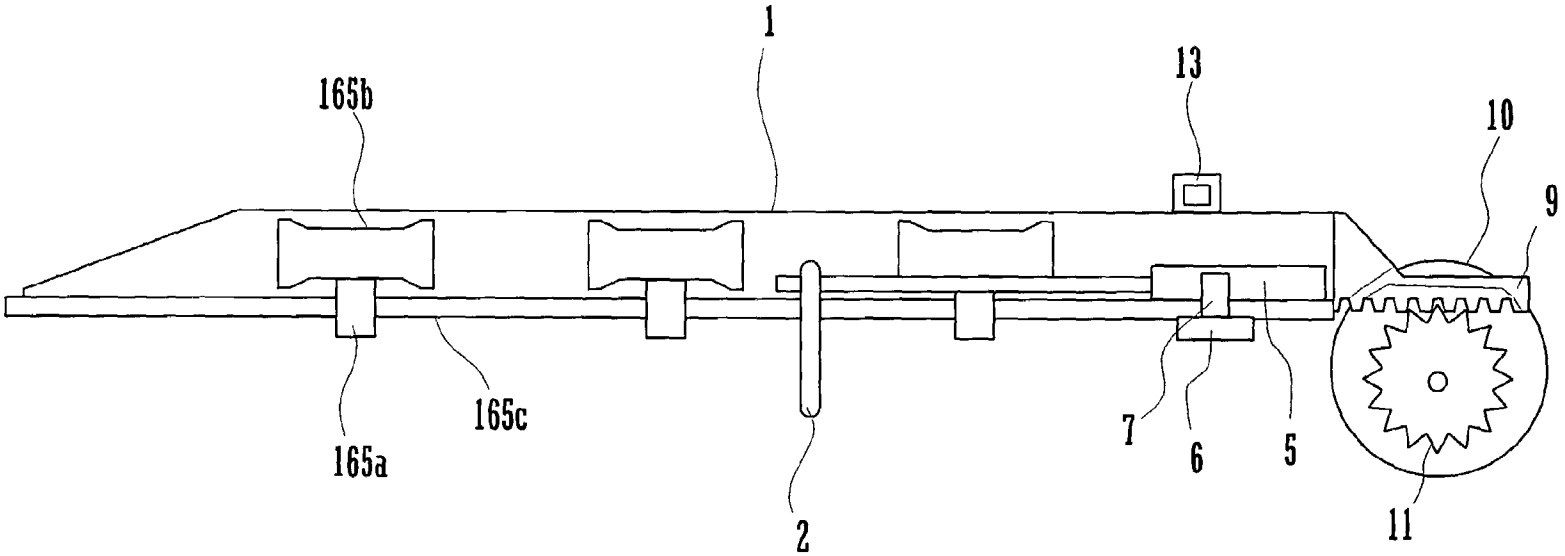
FIG. 4 is a side view of the separator.

FIG. 2 is an enlarged view of a configuration of the vicinity of the sheet eject rollers 165. FIG. 3 is an external view of the separator 1 in the image forming apparatus 100. FIG. 4 is a side view of the separator 1. As described above, the sheet eject rollers 165 function to eject onto the sheet eject tray 170*b* a recording sheet transported through the sheet transport path 160 by the transport rollers 163. The sheet eject rollers 165 are rotatably supported at an upper part on one end of the sheet eject tray 170*b* by the separator 1 provided so as to be movable back and forth within a predetermined range in the direction orthogonal to the sheet transport direction.

In more detail, the sheet eject rollers 165 are composed of a plurality of drive rollers 165*a* placed at a lower position and the same number of driven rollers 165*b* arranged at an upper position opposite the drive rollers 165*a*. The drive rollers 165*a* are supported so as to be axially slidable by a rotating shaft 165*c*. The rotating shaft 165*c* is rotatably supported by a frame 101 of the image forming apparatus 100, and supplied torque by a drive motor (not shown). The drive rollers 165*a* and the driven rollers 165*b* move as the separator 1 moves in the direction orthogonal to the sheet transport direction.

The driven rollers 165*b* are spool-shaped when viewed from the sheet transport direction, and during passage between the drive rollers 165*a* and the driven rollers 165*b*, a recording sheet to be ejected onto the sheet eject tray 170*b* is given a deformation force, so that the sheet is concave-curved. Consequently, the recording sheet quickly falls away from the separator 1 after the rear end of the sheet passes between the drive rollers 165*a* and the driven rollers 165*b*, without a portion of the sheet which passes between the drive rollers 165*a* and the driven rollers 165*b* hanging down and thus prematurely contacting a surface of the sheet eject tray 170*b* or the top of recording sheets stacked on the sheet eject tray 170*b*.

On a first end on the sheet eject tray 170*b* side thereof, the separator 1 has an actuator 2 extending downward therefrom, and on a second end supports in a rotatable manner a shaft 3 provided with a detector blade 4. On the sheet eject tray 170*b* side of the separator 1, a support piece 6 is formed to project. Fixed to an upper surface of the support piece 6 is a fill-up sensor 7 which is a photocoupler including light emitting elements and light receiving elements. An open end of the actuator 2 is arranged to abut on a top of recording sheets stacked and stored on the sheet eject tray 170*b*.

As more and more recording sheets are stacked on the sheet eject tray 170*b*, a position at which the open end of the actuator 2 abuts on the top of the recording sheets is raised. The upward displacement of the open end of the actuator 2 causes the shaft 3 to rotate, such that the detector blade 4 is displaced from a position where the blade 4 blocks a space between the light emitting elements and the light receiving elements to a position where the blade 4 does not.

In a state in which the number of recording sheets stacked on the sheet eject tray 170*b* is so small that the open end of the actuator 2 does not abut on the top of the recording sheets, the detector blade 4 blocks the space between the light emitting elements and the light receiving elements and thus the fill-up sensor 7 is in OFF state. As the number of the recording sheets stacked on the sheet eject tray 170*b* gradually increases, the open end of the actuator 2 abuts on the top of the recording sheets, thereby the shaft 3 being rotated. Thus, the detector blade 4 is moved upward, until the blade 4 does not block the space between the light emitting elements and the light receiving elements when the fill-up sensor is turned on. At the time it is determined that the sheet eject tray 170*b* is filled to capacity thereof.

Usable as the fill-up sensor 7 is not only a photocoupler but also any arbitrary sensor capable of detecting the displacement of the detector blade 4. When the fill-up sensor 7 detects that the sheet eject tray 170*b* is filled to capacity thereof, the sheet eject tray 170*b* has five hundred sheets of recording sheets which are standard paper stacked thereon, for example.

A rack gear 9 extends from a point on a back side of the separator 1. The rack gear 9 engages with a pinion gear 11 fixed to a rotatory shaft of a drive motor 10 which is fixed to a frame 101 of the image forming apparatus 100. The rotatory shaft of the drive motor 10 rotates selectively in forward and backward directions. The rotation of the rotatory shaft is transferred via the pinion gear 11 and the rack gear 9 to the separator 1 as the energy of the separator 1 moving forth and back in the direction orthogonal to the sheet transport direction.

On the sheet transport path 160 side of the separator 1, a detector piece 12 extends. The detector piece 12 is arranged to face a position sensor 13 fixed to the frame 101 of the image forming apparatus 100. The position sensor 13 detects via the detector piece 12 the position of the separator 1 in the direction orthogonal to the sheet transport direction.

An ejection sensor 14 is provided upstream of the separator 1 in the sheet transport path 160. There the ejection sensor 14 detects the presence or absence of the recording sheets.

Figure 5:
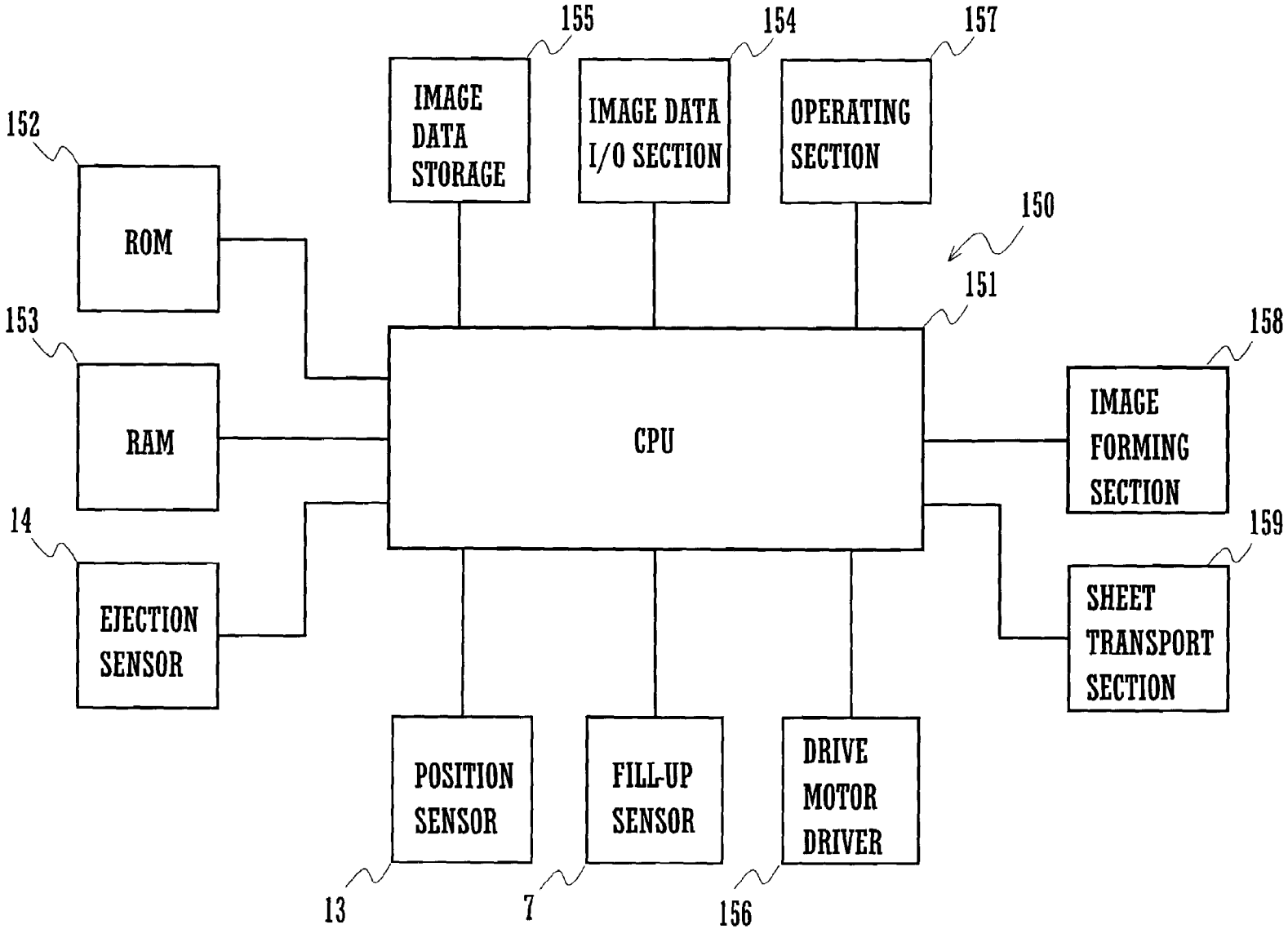
FIG. 5 is a block diagram showing a configuration of a control device of the image forming apparatus.

FIG. 5 is a block diagram of a configuration of the control device 150 of the image forming apparatus 100. The control device 150 is configured by connecting to CPU 151 provided with ROM 152, RAM 153, an image data input/output section 154 and an image data storage 155, the fill-up sensor 7, the position sensor 13, the ejection sensor 14, and a drive motor driver 156, together with input/output devices such as an operating section 157, an image forming section 158, and a sheet transport section 159.

The CPU 151 performs over control of the input/output devices according to programs written in the ROM 152. Under the control, data input to or output from the CPU 151 is stored in the memory area of the RAM 153. After temporarily storing in the image data storage 155 image data input via the image data input/output section 154 from external devices, the CPU 151 delivers the image data to the exposure units 113*a* to 113*d* included in the image forming section 158.

The CPU 151 activates motors and clutches included in the sheet transfer section 159 at a predetermined timing, thereby causing recording sheets stored in the sheet feed tray 140 to be transported sheet by sheet in the sheet transport path 160. The CPU 151 also controls the charging devices 112*a* to 112*d* included in the image forming section 158, according to image-forming conditions set by operating key switches included in the operating section 157. When directed by operating the key switches to sort recording sheets, the CPU 151 controls the sheet transport section 159 in consideration of other set image-forming conditions and of detection results of the sensors 13 and 14.

Figure 6C:
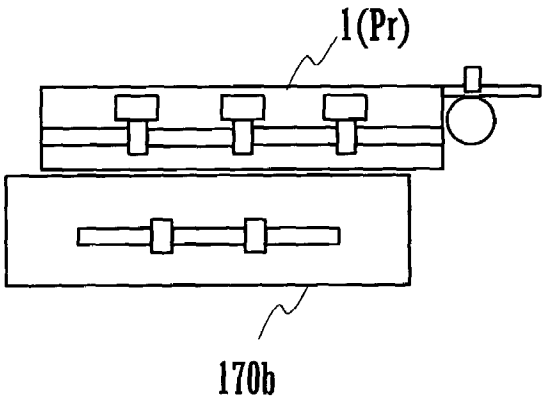
FIGS. 6A to 6C are side views illustrating how the separator moves.
Figure 6B:
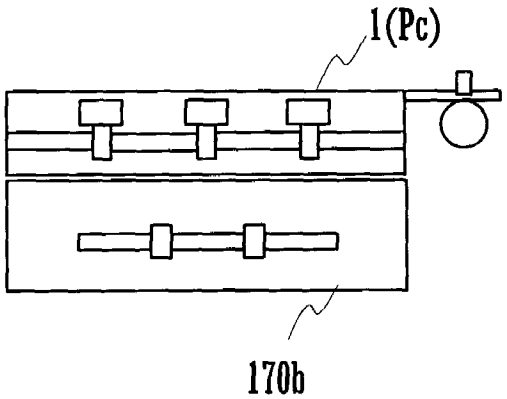
Figure 6A:
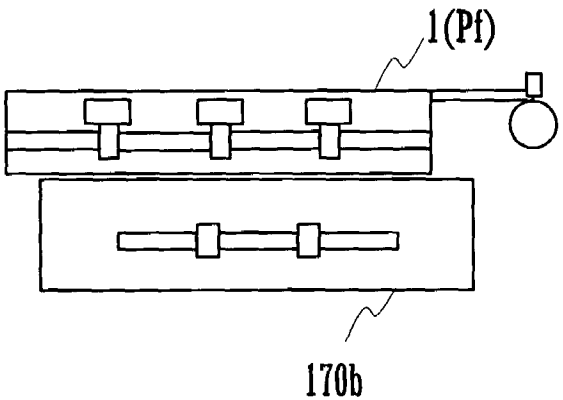
Figure 7:
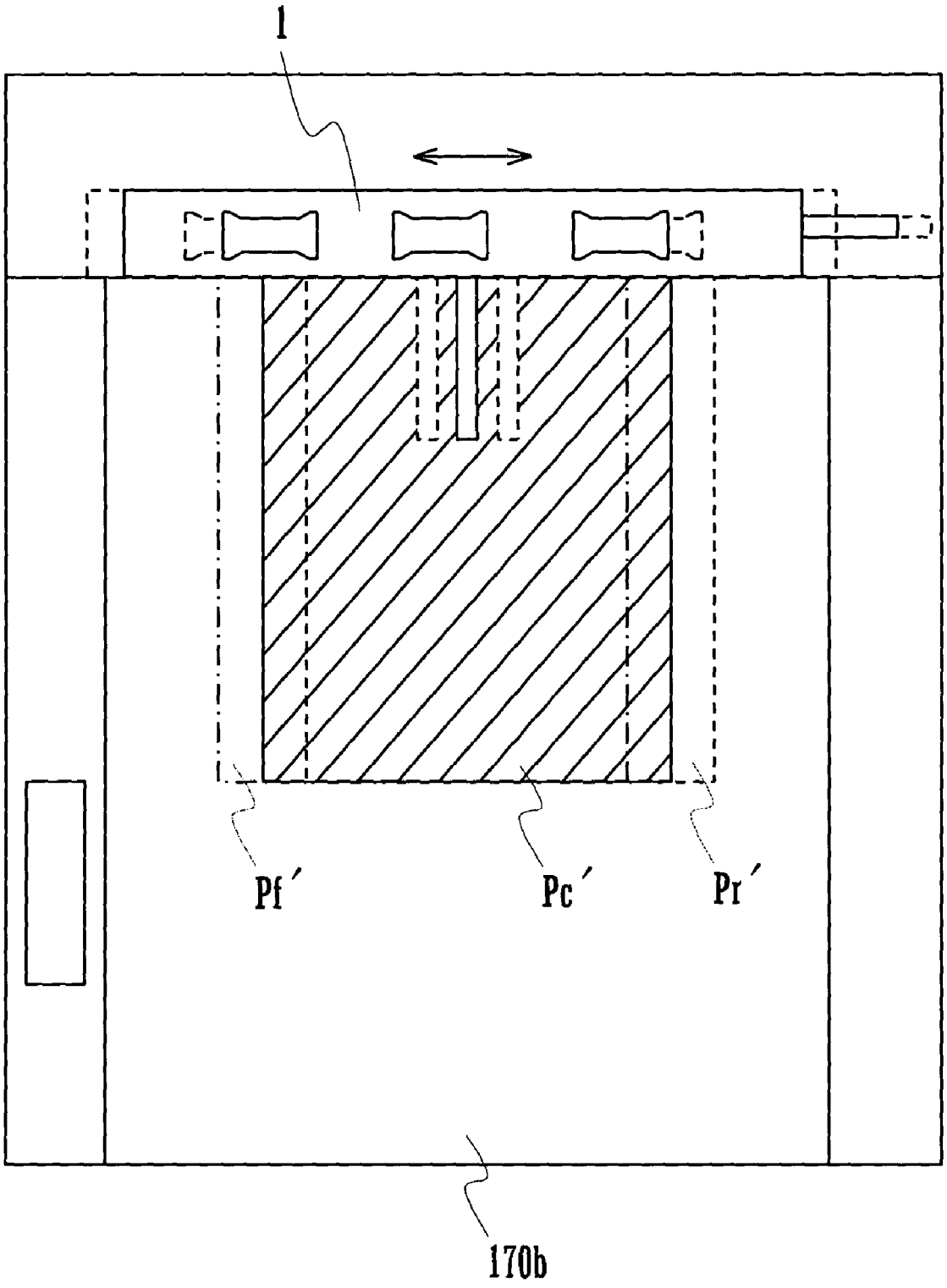
FIG. 7 is a top plane view showing recording sheet eject positions on a sheet eject tray.
Figure 8:
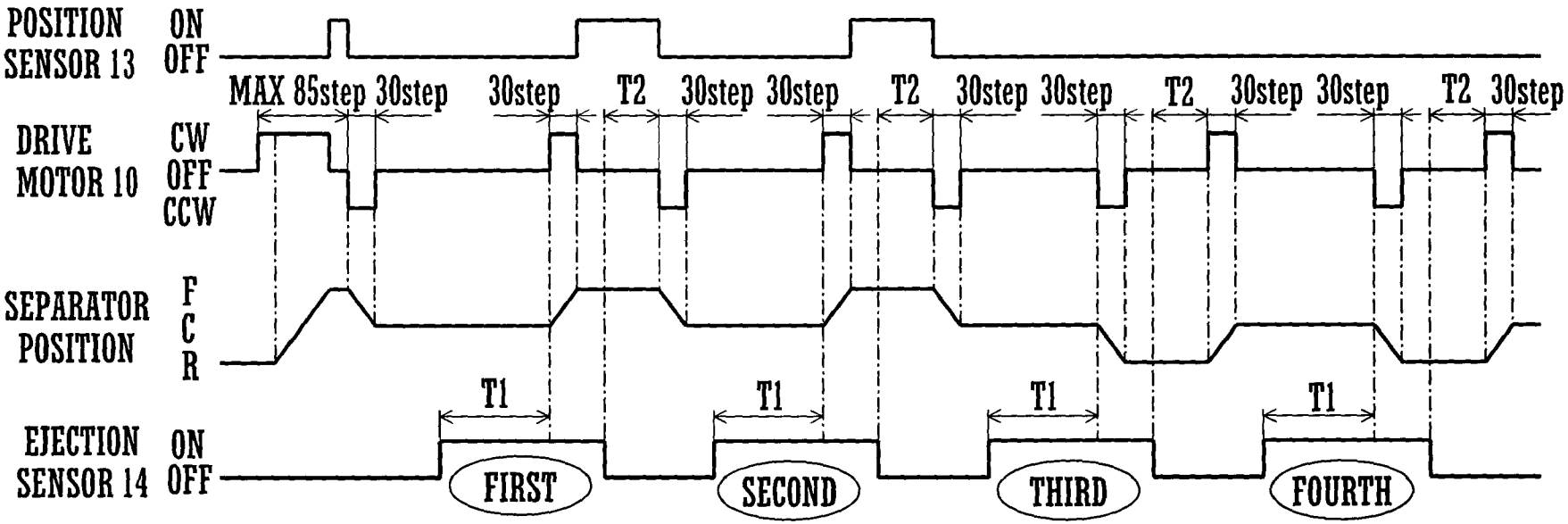
FIG. 8 is a timing diagram showing how the separator operates in the image forming apparatus.

FIGS. 6A to 6C are side views illustrating how the separator 1 moves. FIG. 7 is a top plane view showing a recording sheet eject position on the sheet eject tray 170*b*. FIG. 8 is a timing diagram showing how the separator 1 operates in the image forming apparatus 100. The separator 1 including the sheet eject rollers 165 is allowed to move between three positions in the direction orthogonal to the sheet transport direction on one upper end of the sheet eject tray 170*b*: (1) an initial position Pc as shown in FIG. 6B, (2) a front-side sorting position Pf as shown in FIG. 6A, and (3) a rear-side sorting position Pr as shown in FIG. 6C. The front-side sorting position Pf and the rear-side sorting position Pr are sorting positions arranged on both sides of the initial position Pc of the present invention.

In the image forming apparatus 100 according to the present embodiment, the distance between the initial position Pc and the front-side sorting position Pf, and between the initial position Pc and the rear-side sorting position Pr, is set to 15 mm, for example.

The separator 1 can be made to move back and forth between the front-side sorting position Pf and the rear-side sorting position Pr with either of the two sorting positions set as the initial position Pc. In this case, it is not necessary to move the separator 1 after recording sheets are ejected to the first sorting position set as the initial position Pc. After recording sheets are ejected to the second sorting position, however, it is necessary to move the separator 1 by 30 mm in its return to the initial position Pc. The travel distance doubles, and thus the separator 1 takes a longer time to return to the initial position Pc.

When directed to sort recording sheets on the sheet eject tray 170*b*, The separator 1 moves back and forth between the initial position Pc and the front-side sorting position Pf and between the initial position Pc and the rear-side sorting position Pr, so as to sort and eject the recording sheets to a front-side eject position Pf' and a rear-side eject position Pr'. When not directed to sort recording sheets, the separator 1 ejects the recording sheets to an initial eject position Pc' on the sheet eject tray 170*b*.

The positions in the direction orthogonal to the sheet transport direction of the separator 1 are detected by the position sensor 13. The position sensor 13 is composed of a photocoupler including light emitting elements and light receiving elements. When the separator 1 is positioned at the front-side sorting position Pf, a gap between the light emitting elements and the light receiving elements of the position sensor 13 is open, so that a detection signal of the position sensor 13 is turned on. Before starting image forming processes, the CPU 151 in the control device 150 identifies a present position of the separator 1 according to ON/OFF state of the detection signal of the position sensor 13, and then positions the separator 1 to the initial position Pc by performing a predetermined process.

For example, suppose a case where the position sensor 13 and the detector piece 12 are arranged so that the detection signal is turned on when the separator 1 is positioned on the front side with respect to the initial position Pc. In the case, the separator 1 is moved to the front side if the gap between the light emitting elements and the light receiving elements is blocked with the result that the detection signal of the position sensor 13 is turned off (namely, if the separator 1 is positioned on the rear side with respect to the initial position Pc); and the separator 1 is moved to the rear side if the gap is open with the result that the detection signal is turned on (namely, if the separator 1 is positioned on the front side with respect to the initial position Pc). When the detection signal of the position 13 By the movements, the separator is identified to be positioned at the initial position Pc. With respect to the initial position Pc, the separator 1 can be moved to desired positions, by varying the number of its driving step, for example, if the drive motor 10 is a stepping motor.

In the image forming apparatus 100 according to the present embodiment, the detector piece 12 and the position sensor 13 are arranged so that the detection signal of the position sensor 13 is turned on when the separator 1 is positioned at the front-side sorting position Pf. Accordingly, the CPU 151 first moves the separator 1 to the front side by rotating the drive motor in a normal direction of rotation until the position sensor 13 is turned on (during this period, the drive motor 10 is driven to rotate by up to 85 steps). Then the drive motor 10 is rotated in the reverse direction by 30 steps. The rotation by 30 steps of the drive motor 10 corresponds to the travel distance of 15 mm of the separator 1 between the initial position Pc and the front-side sorting position Pf, and between the initial position Pc and the rear-side sorting position Pr. This operation causes the separator 1 to be positioned at the initial position Pc.

As shown in FIG. 8, when directed to sort two copies of recording sheets with each copy including two sheets (four sheets in total), the CPU 151 starts an image forming process by controlling the image forming section 158 and the sheet transport section 159 with the separator 1 positioned at the initial position Pc. Regarding first and second recording sheets on which images are formed, when the ejection sensor 14 detects a front end of each recording sheet and is thus turned on, the CPU 151 rotates the drive motor 10 by 30 steps in the normal direction of rotation after a lapse of waiting time T1, thereby moving the separator 1 to the front-side sorting position Pf with the recording sheets held between the sheet eject rollers 165. When the recording sheets are ejected by the rotating sheet eject rollers 165 to the front-side eject position Pf' and the ejection sensor 14 detects passage of rear ends of the recording sheets, the CPU 151 rotates the drive motor 10 by 30 steps in the reverse direction after a lapse of delay time T2, thereby moving the separator 1 back to the initial position Pc.

Regarding third and fourth recording sheets on which images are formed, when the ejection sensor 14 detects a front end of each recording sheet and is thus turned on, the CPU 151 rotates the drive motor 10 by 30 steps in the reverse direction of rotation after a lapse of waiting time T1, thereby moving the separator 1 to the rear-side sorting position Pr with the recording sheets held between the sheet eject rollers 165. When the recording sheets are ejected by the rotating sheet eject rollers 165 to the rear-side eject position Pr' and the ejection sensor 14 detects passage of rear ends of the recording sheets, the CPU 151 rotates the drive motor 10 by 30 steps in the normal direction after a lapse of delay time T2, thereby moving the separator 1 back to the initial position Pc.

As described above, the CPU 151 sort the four recording sheets into the two copies with each copy including two sheets on the sheet eject tray 170*b*, by ejecting the first and second recording sheets to the front-side eject position Pf' on the tray 170*b* and the third and fourth recording sheets to the rear-side eject position Pr' on the tray 170*b*.

In the foregoing operation, the waiting time T1 is a period between when the time the front ends of the recording sheets to be ejected reach the ejection sensor 14 and the time when the rear ends of the recording sheets pass through the transport rollers 163 and thus the separator 1 becomes ready to move in the direction orthogonal to the sheet transport direction. The length of the waiting time T1 depends, if sheet transport speed remains constant, on sheet size, namely, length in the sheet transport direction of the recording sheets. The sheet size affecting the waiting time T1 is obtained from settings in the operating section 157, detected value in the sheet transport path 160, or detected value in the sheet feed tray 140.

The delay time T2 is an amount of time that it takes before a recording sheet is stably positioned at the front-side eject position Pf' or the rear-side eject position Pr' and thus the separator 1 becomes ready to move back to the initial position Pc after the rear ends of the recording sheets to be ejected pass the ejection sensor 14 and the recording sheet falls away adequately distant from the separator 1 or completes on the sheet eject tray 170*b* a movement opposite to a direction in which the recording sheet is ejected (hereinafter referred to as the sheet eject direction).

Figure 9A:
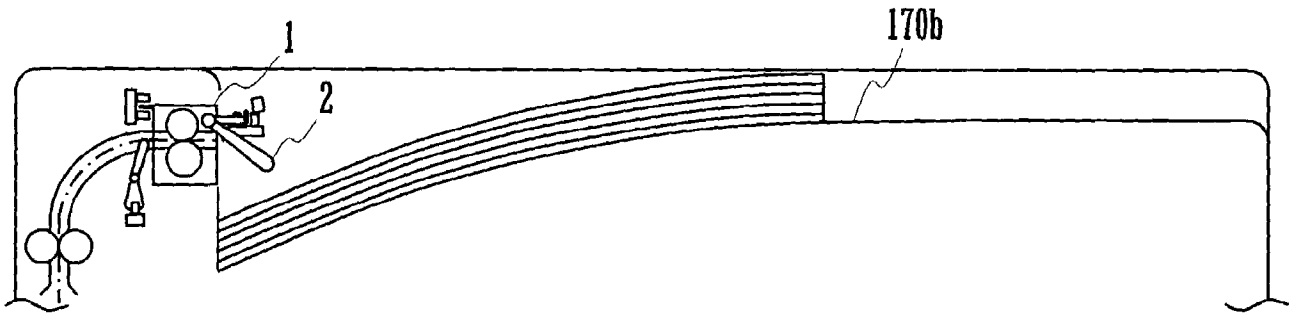
FIGS. 9A to 9C are views illustrating how recording sheets are stacked on the sheet eject tray of the image forming apparatus.

The delay time T2 is affected by the number of recording sheets stacked on the sheet eject tray 170*b*. If the number of recording sheets on the sheet eject tray 170*b* is smaller than a predetermined number, as shown in FIG. 9A, a top surface of the recording sheets ejected on the sheet eject tray 170*b* is completely distant from the actuator 2. Therefore, if the separator 1 is made to start moving back while a recording sheet is moving in the opposite direction to the sheet eject direction, external force from the actuator 2 in a direction orthogonal to the sheet eject direction does not act on the unstable recording sheet, and thus the recording sheets on the sheet eject tray 170*b* do not become disordered.

Figure 9B:
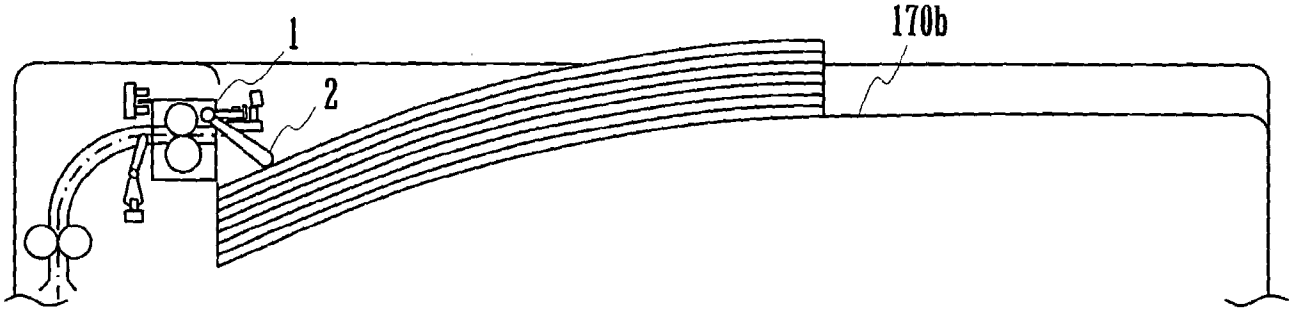
Figure 9C:
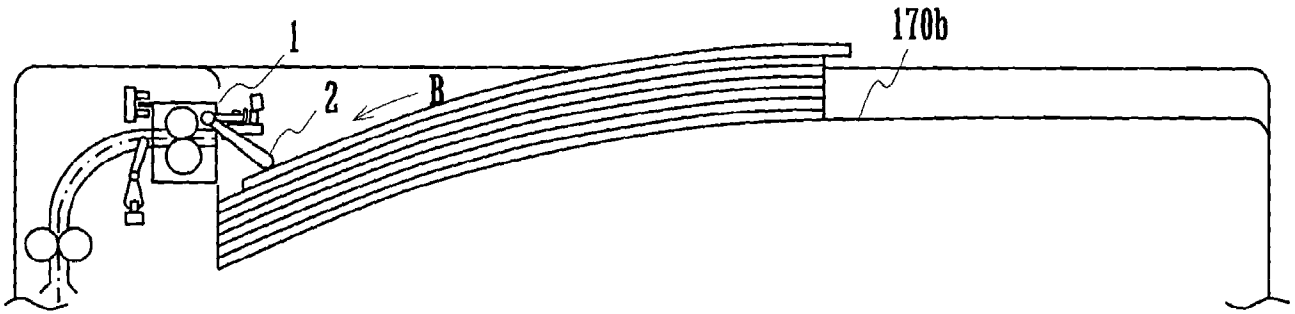

As shown in FIG. 9B, however, if the number of recording sheets on the sheet eject tray 170*b* is larger than a predetermined number, a top surface of the recording sheets ejected on the sheet eject tray 170*b* is constantly in contact with the actuator 2. As shown in FIG. 9C, therefore, if the separator 1 is made to start moving back while a recording sheet fallen on top of the recording sheets on the sheet eject tray 170*b* is moving in the direction of an arrow B in a direction opposite to the sheet eject direction, external force from the actuator 2 in the direction orthogonal to the sheet eject direction acts on the unstable recording sheet. Consequently, the recording sheet is displaced in the direction orthogonal to the sheet eject direction and the recording sheets on the sheet eject tray 170*b* become disordered.

The delay time T2 is also limited by an interval between recording sheets transported in succession which varies according to sheet size and image-forming speed. The interval is a time between the passage of the rear end of a former recording sheet and the passage of the frond end of a latter recording sheet, hereinafter referred to as a sheet transport interval. In a sorting process the separator 1, after ejecting a former recording sheet to the sheet eject tray 170*b* at the front-side sorting position Pf or at the rear-side sorting position Pr, needs to move back to the initial position Pc before the front end of a latter recording sheet reaches the sheet eject rollers 165. Accordingly, the delay time T2 cannot be extended beyond the sheet transport interval minus the time that it takes the separator 1 to move back (from the front-side sorting position Pf or the rear-side sorting position Pr to the initial position Pc).

Shown in FIG. 12 is an example of the relationships between (1) sheet size and (2) image-forming speed and the sheet transport interval. The image-forming speed (ppm), namely, the number of recording sheets on which images are formed per unit time (one minute), is selected according to the sheet size from multiple kinds of preset ones. In the image forming apparatus 100 according to the present embodiment, image-forming speeds under normal control are preset as follows: 26 ppm for A5, B5, A4, INV, and LT sizes; 18 ppm for B5R, A4R, and LTR sizes; 15 ppm for B4 and Legal sizes; 13 ppm for A3 and Ledger sizes. In addition, the B5R, A4R, and LTR sizes are respectively the B5, A4, and LT sizes with their longitudinal direction as their transport direction.

In the image forming apparatus 100 according to the present embodiment, it takes approximately 180 ms for the separator 1 to travel the distance of 15 mm between each of the front-side sorting position Pf and the rear-side sorting position Pr and the initial position Pc. Besides, types such as thickness of a recording sheet, states such as curls on the recording sheet, a detection accuracy error of the ejection sensor 14, the time it takes for the separator 1 to stop completely, and so on considered, it takes approximately 250 ms for the separator 1 to move back.

As the delay time T2, which is the time it takes before the separator 1 starts moving back to the initial position Pc after the rear end of a recording sheet passes before the ejection sensor 14, a time period of approximately 200 ms is required if there is a small number of recording sheets on the sheet eject tray 170*b*, and a time period of about 300 ms is required if there is a larger number of recording sheets on the sheet eject tray 170*b* than a predetermined number (namely, if a top surface of recording sheets on the sheet eject tray 170*b* is constantly in contact with the actuator 2).

As described above, the sheet transport interval needs to be longer than the sum of the time it takes the separator 1 to move back and the delay time T2. The sheet transport interval depends on the image-forming speed and the sheet size. When the image-forming speed is low in comparison with length in the sheet transport direction of a recording sheet, as in the recording sheets of A5, B5R, A3 and INV sizes in the example under the normal control (control in a case where recording sheets are not to be sorted) as shown in FIG. 12, the sheet transport interval is sufficiently long. Therefore, even if a sufficiently long period of time is set as the delay time T2, which is a time that it takes before the rear end of the recording sheet, after passing before the ejection sensor 14, reaches a position where it is not in contact with the separator 1, the separator 1 is allowed to complete its movement back to the initial position Pc during the sheet transport interval.

However, depending on recording sheet size, the sheet transport interval is extremely short in some cases. In such cases, if there is a larger number of recording sheets on the sheet eject tray 170*b* than a predetermined number, a time that it takes before a recording sheet completes its movement in the direction opposite to the sheet eject direction on the sheet eject tray 170*b* after the rear end of the recording sheet passes before the ejection sensor 14 is sometimes longer than the sheet transport interval minus a time that it takes the separator 1 to move back. Consequently, when a sufficient long period of time is set as the delay time T2, the separator 1 is not allowed to complete its movement back to the initial position Pc during the sheet transport interval.

In the example under normal control as shown in FIG. 12, for example, a sheet transport interval of a A4-size recording sheet is 513 ms, and a sheet transport interval of a LT-size recording sheet is 462 ms. When the delay time T2 of about 300 ms required if there is a large number of recording sheets on the sheet eject tray 170*b* is subtracted from the sheet transport interval, a time period usable for moving back the separator 1 is 213 ms for the delay time T2 of the A4-size recording sheet and 162 ms for the delay time T2 of the LT-size recording sheet. Thus, in a case where there is a large number of recording sheets on the sheet eject tray 170*b*, it is not possible to move the separator 1 back to the initial position Pc before the next recording sheet is transported, so that recording sheet jam occurs before the separator 1.

In the image forming apparatus 100 according to the present embodiment, when directed to sort recording sheets, the sheet transport section 159 or the drive motor 10 is controlled differently according to a sheet transport interval so that the separator 1, after ejecting a recording sheet at the sorting position Pf or Pr, is made to be able to move back to the initial position Pc before the next recording sheet is transported, thereby ensuring that the occurrence of recording sheet jam before the separator 1 is prevented.

Figure 10:
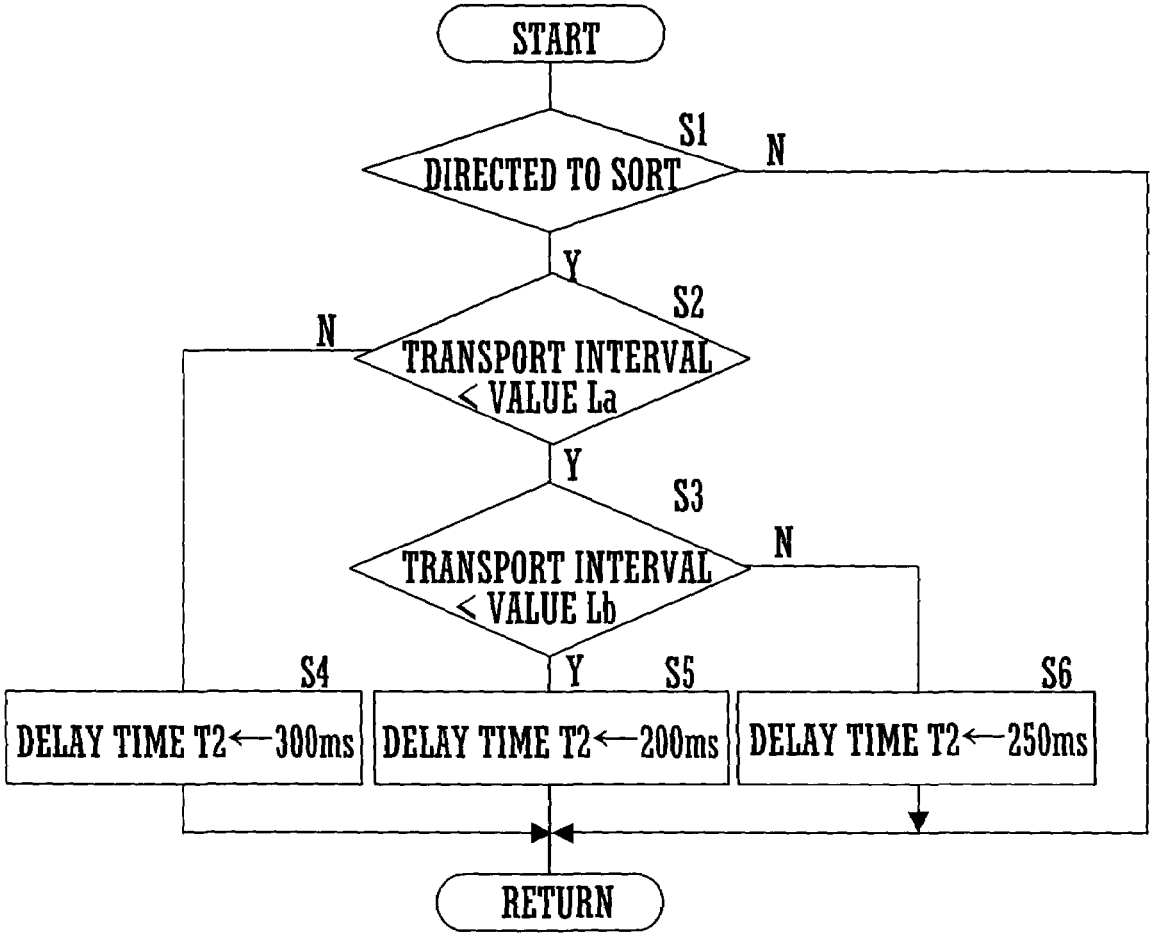
FIG. 10 is a flowchart illustrating part of a procedure taken in the control device of the image forming apparatus.

FIG. 10 is a flowchart illustrating a procedure taken in the control device 150 when sorting of recording sheets is directed. The CPU 151 in the control device 150 determines at a timing at which each recording sheet is fed in an image forming process whether or not sorting of the recording sheet is directed (step S1). When directed to sort the recording sheet, the CPU 151 determines according to a size of the recording sheet among the set image forming conditions whether or not a sheet transport interval L in the sheet transport path 160 in the image forming process is shorter than a first predetermined value La (step S2). If the sheet transport interval L is longer than the predetermined value La, the CPU 151 sets a delay time T2 determining a timing at which the separator 1 starts to move back to the initial position Pc, to 300 msec, the longest time period settable (step S4).

If the sheet transport interval L is shorter than the predetermined value La in step S2, the CPU 151 determines according to a size of the recording sheet among the set image forming conditions whether or not the sheet transport interval L in the sheet transport path 160 in the image forming process is shorter than a second predetermined value Lb (step S3). If the sheet transport interval L is shorter than the predetermined value Lb, the CPU 151 sets the delay time T2 determining a timing at which the separator 1 starts to move back to the initial position Pc to 200 msec, the shortest delay time settable (step S5). If the sheet transport interval L is longer than the predetermined value Lb, the CPU 151 sets the delay time T2 determining a timing at which the separator 1 starts to move back to the initial position Pc to 250 msec (a reference delay time of the present invention), the intermediate delay time settable (step S6).

In the above process, the predetermined values La and Lb are reference transport intervals of the present invention.

In steps S2 and S3, the CPU 151 refers to relationships between recording sheet size and transport interval which are pre-stored in the ROM 152. In the image forming apparatus 100 according to the present embodiment, the predetermined values La and Lb in steps S2 and S3 are set to 550 ms and 500 ms respectively, for example. As is clear from the relationship shown in FIG. 12, A4-size and LT-size recording sheets satisfy the relationship in step S2, and an LT-size recording sheet satisfy the relationship in step S3. In an image forming process, the CPU 151 times the delay time T2 with a timer assigned to part of memory areas of the RAM 153, and sets the separator 1 moving back to the initial position Pc as the timer activated when the detection signal of the ejection sensor 14 is turned off is up.

Accordingly, in a case of an A4-size recording sheet the CPU 151 proceeds through steps S2 and S3 on to step S6, setting the delay time T2 to 250 msec. In a case of an LT-size recording sheet the CPU 151 proceeds through steps S2 and S3 on to step S5, setting the delay time T2 to 200 msec. In a case of a recording sheet of size other than A4 and LT sizes, the CPU 151 proceeds through step S2 on to step S4, setting the delay time T2 to 300 msec under normal control.

As described above, in the image forming apparatus 100 according to the present embodiment, the delay time T2 is appropriately adjusted according to a transport interval corresponding to recording sheet size, thereby ensuring that a recording sheet is prevented from being transported to the separator 1 before the separator 1, after ejecting the preceding recording sheet, returns to the initial position Pc and thus sorting processing on the sheet eject tray 170*b* is performed without recording sheet jam.

Figure 11:
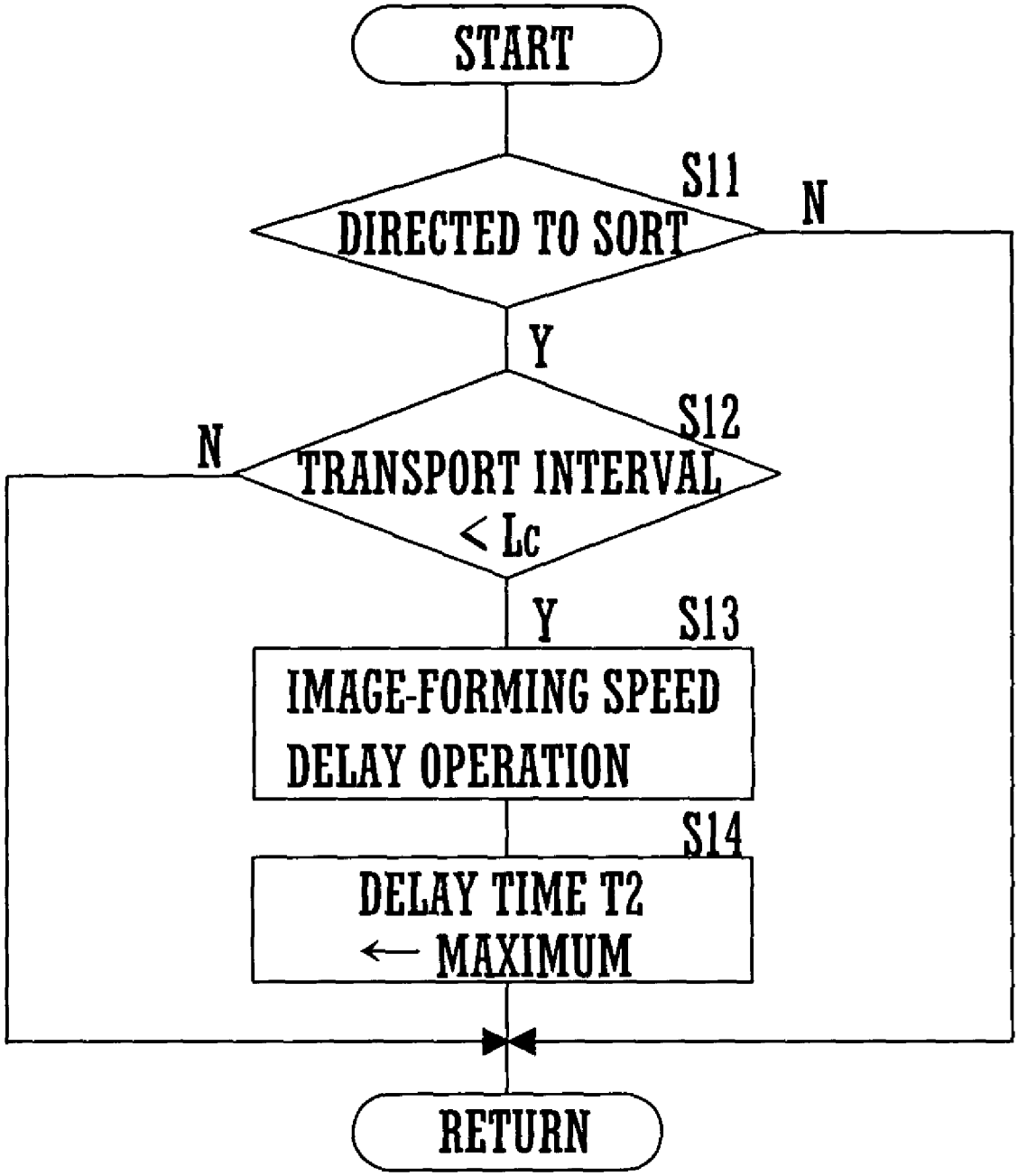
FIG. 11 is a flowchart illustrating part of processing procedures taken in a control device of an image forming apparatus according to another embodiment of the present invention.

FIG. 11 is a flowchart illustrating a procedure taken in a control device when sorting of recording sheets is directed, in an image forming apparatus according to another embodiment of the present invention. The CPU 151 in the control device 150 determines at a timing at which each recording sheet is fed in an image forming process whether or not sorting of the recording sheet is directed (step S11). When directed to sort the recording sheet, the CPU 151 determines according to a size of the recording sheet among the set image forming conditions whether or not a sheet transport interval L in the sheet transport path 160 in the image forming process is shorter than a predetermined value Lc (a standard transport interval of the present invention) (step S12). If the sheet transport interval L is shorter than the predetermined value Lc, the CPU 151 operates to delay an image-forming speed (step S13), setting the delay time T2 to a maximum value settable (step S14).

In step S12, for example, the CPU 151 compares the sheet transport interval L under normal control with the predetermined value Lc=550 ms. In the case, as shown in FIG. 12, the CPU 151 operates to delay image-forming speed when a recording sheet is A4 or LT size, and reduces image-forming speed from 26 ppm (corresponding to a first image-forming speed of the present invention) to 24 ppm (a second image-forming speed of the present invention). By the operation the sheet transport interval L is extended to 705 ms in the A4-size sheet, and to 655 ms in the LT-size sheet. Thus, if the delay time T2 is set to the maximum value 300 ms, there remain time periods of 405 ms in the A4-size sheet and 355 ms in the LT-size sheet. Since it takes approximately 250 ms for the separator 1 to return to the initial position Pc, such periods are sufficient for ensuring completion of the return movement of the separator 1.

In the delay operation in step S13, the CPU 151 controls the sheet transport section 159 so as to delay a timing at which a recording sheet is transported from the sheet feed tray 140 to the image forming stations 110*a* to 110*d*. Because of the operation, it is not necessary to change image forming processes in the image forming stations 110*a* to 110*d* or recording sheet transport speed in the sheet transport path 160, with the result that the operation itself does not become complicated.

As described above, in the image forming apparatus 100 according to the present embodiment, the image forming speed, namely, the number of recording sheets on which images are formed per unit time, is appropriately adjusted according to a transport interval corresponding to recording sheet size, thereby ensuring that a recording sheet is prevented from being transported to the separator 1 before the separator 1, after ejecting the preceding recording sheet, returns to the initial position Pc and thus sorting processing on the sheet eject tray 170*b* is performed without recording sheet jam.

In one aspect of the present invention, when sheets each with an image formed thereon are sorted by displacing the sheets to different positions in the direction orthogonal to the sheet transport direction to be stacked on the sheet eject tray, the delay time required for the sheet eject mechanism to start its return to the initial position after ejecting a sheet is regulated so that the sheet eject mechanism completes its return to the initial position within the transport interval. When the transport interval becomes shorter according to sheet size or image-forming speed, the delay time required for the sheet eject mechanism to start its return to the initial position after ejecting a preceding sheet is accordingly shortened, thereby ensuring that the sheet eject mechanism returns to the initial position before the following sheet reaches the sheet eject mechanism. This arrangement ensures that sheet jam before the sheet eject mechanism is prevented and thus the sheet eject mechanism is allowed to perform serial sheet sorting processing properly.

In another aspect of the present invention, regarding the transport interval and the delay time, the reference transport interval and the reference delay time corresponding to the reference transport interval are respectively preset. If the transport interval according to sheet size or image-forming speed is longer than the reference transport interval, then the delay time is extended beyond the reference delay time; and if the transport interval is shorter than the reference transport interval, the delay time is shortened below the reference delay time. In this way, if the transport interval changes according to sheet size and image-forming speed, the delay time is properly adjusted in accordance with the reference delay time corresponding to the reference transport interval, depending on whether the changed transport interval is longer or shorter than the reference transport interval. This arrangement further ensures that sheet jam before the sheet eject mechanism is prevented and thus the sheet eject mechanism is allowed to perform serial sheet sorting processing properly.

In another aspect of the present invention, regarding the transport interval and the delay time, the reference transport interval and the reference delay time corresponding to the reference transport interval are respectively preset. In sheet sorting processing regarding a sheet of a particular size in which the transport interval is shorter than the reference transport interval, the sheet eject mechanism is set returning to the initial position in a shorter time than the reference transport interval after ejecting the sheet. In this way, the optimum delay time according to the transport interval can be set immediately based on the result of determining whether or not the sheet is of the particular size.

In another aspect of the present invention, as image-forming speed, namely, the number of sheets each with an image formed thereon per unit time, the first image-forming speed and the second image-forming speed with its value less than the first image-forming speed both of which are used when sheet sorting processing is not performed are made available to be set selectively. By setting either of the first image-forming speed and the second image-forming speed according to a required sheet transport interval in sorting processing, sufficient time is allowed for an ejected sheet to become distant from the sheet eject mechanism and for the ejected sheet to complete its movement in the opposite direction to the sheet eject direction on the sheet eject tray, as the delay time required for the sheet eject mechanism to be set returning to the initial position after ejecting the sheet.

In another aspect of the present invention, when the sheet transport interval at the first image-forming speed is longer than the preset reference transport interval, sheet sorting processing is performed at the first image-forming speed; when the sheet transport interval is shorter than the preset reference transport interval, sheet sorting processing is performed at the second image-forming speed with its value less than the first image-forming speed, with the sheet transport interval extended. This arrangement prevents the sheet transport interval from becoming shorter than the reference transport interval in sheet sorting processing, thereby allowing sufficient time as the time required for an ejected sheet from the sheet eject mechanism to become distant from the sheet eject mechanism, the time required for the ejected sheet to complete its movement in the direction opposite to the sheet eject direction, and the time required for the sheet eject mechanism to return to the initial position after ejecting the sheet.

In another aspect of the present invention, regarding the sheet transport interval the reference transport interval is preset. In sorting processing regarding a sheet of a particular size with its transport interval shorter than the reference transport interval, the second image-forming speed with its value less than the first image-forming speed is set as the image-forming speed. Consequently, the image-forming speed required for sufficient time to be obtained as the time required for the sheet ejected from the sheet eject mechanism to become distant from the sheet eject mechanism, the time required for the ejected sheet to complete its movement in the direction opposite to the sheet eject direction on the sheet eject tray, and the time required for the sheet eject mechanism to return to the initial position after ejecting the sheet, can be set quickly according to the result of determining whether or not the sheet is the particular size.

In yet another aspect of the present invention, by delaying a timing at which a sheet is transported to the image forming section thereby reducing the number of sheets on which images are formed per unit time, regulation of the speed of processing in the image forming section or the speed of sheets passing in the sheet transport path is not necessary for controlling the number of sheets with images formed thereon per unit time. This arrangement allows the control in sheet sorting processing to be prevented from becoming complicated, and simplifies contents of the control.

In still another aspect of the present invention, sheets to be sorted are ejected alternately to the initial position and the sorting positions arranged on both sides of the initial position in the direction orthogonal to the sheet transport direction, with the result that the distance for the sheet eject mechanism to travel is half the distance between the sheets to be sorted. In comparison with a case where the sheets are sorted between the initial position and a single sorting position, consequently, the time required for the sheet eject mechanism to return from the sorting position to the initial position is shortened and the delay time for the sheet eject mechanism to be set returning after ejecting a sheet is extended. This arrangement allows sufficient time for the ejected sheet to become distant from the sheet eject mechanism and for the ejected sheet to complete its movement in the direction opposite to the sheet eject direction on the sheet eject tray.

What is claimed is:

1. An image forming apparatus comprising:

a sheet eject mechanism movable between an initial position and a sorting position in a direction orthogonal to a sheet transport direction in sorting processing, and to eject sheets being sorted by copy or by image-forming job in the sorting processing to a receiving tray, the sheet eject mechanism moving from the initial position to the sorting position with a sheet held therein, the sheet eject mechanism, after electing the sheet to the receiving tray, moving from the sorting position to the initial position without a sheet hold therein; and a control device for determining a delay time required for the sheet eject mechanism to start to return to the initial position after ejecting the sheet to the receiving tray, based on a difference in length between a transport interval that varies according to sizes of sheets being processed and time that it takes the sheet eject mechanism to move back from the sorting position to the initial position, the sheets being transported sequentially to the sheet eject mechanism at the transport interval.

2. The image forming apparatus according to claim 1, wherein the control device compares the transport interval with a preset reference transport interval, thereby setting a longer delay time than a reference delay time corresponding to the reference transport interval if the transport interval is longer than the reference transport interval, and a shorter delay time than the reference delay tin-to if the transport interval is shorter than the reference transport interval.

3. The image forming apparatus according to claim 1, wherein the control device determines whether or not a sheet is of a particular size with its transport interval shorter than the reference transport interval, and if the sheet is of the particular size, sets a shorter delay time than the reference delay time corresponding to the reference transport interval.

4. The image Conning apparatus according to claim 1, wherein the sheet eject mechanism moves with each copy or image-forming job to sort alternately between the initial position and sorting positions arranged on both sides of the initial position in the direction orthogonal to the sheet transport direction.

5. The image funning apparatus according to claim 1, wherein the control device is provided for selectively setting either of a first image-forming speed and a second image-forming speed as an image-forming speed in the sorting processing, the first image-Cotruing speed being used when sorting processing is not performed, and the second image-forming speed being less than the first image-forming speed.

6. The image fanning apparatus according to claim 5, wherein the control device, comparing in sheet sorting processing the transport interval at the first image-forming speed with a preset reference transport interval, sets the first image-forming speed as the image-forming speed in the sorting processing when the sheet transport interval is longer than the preset reference transport interval; and sets the second image-forming speed as the image-forming speed when the sheet transport interval is shorter than the reference transport interval.

7. The image forming apparatus according to claim 5, wherein the control device determines whether a sheet is of a particular size, the sheet transport interval being shorter than the reference transport interval in the particular size, and sets the second image-forming speed when the sheet is of the particular size.

8. The image forming apparatus according to claim 5, wherein the control device changes timings at which a sheet is transported to an image forming section.

9. The image forming apparatus according to claim 5, wherein the sheet eject mechanism moves with each copy of sheets or each image-forming job to sort alternately between the initial position and sorting positions arranged on both sides of the initial position in the direction orthogonal to the sheet transport direction.

10. An image forming apparatus comprising:

a sheet eject mechanism movable between an initial position and a sorting position in a direction orthogonal to a sheet transport direction in sorting processing, and to eject sheets being sorted by copy or by image-forming job in the sorting processing to a receiving tray, the sheet eject mechanism moving from the initial position to the sorting position with a sheet held therein, the sheet eject mechanism, after ejecting the sheet to the receiving tray, moving from the sorting position to the initial position without a sheet held therein; and a control device for regulating a delay time required for the sheet eject mechanism to start to return to the initial position after ejecting the sheet to the receiving tray, wherein the control device regulates the delay time based on detected sizes of sheets being processed, the sheets being transported sequentially to the sheet eject mechanism.

* * * * *